US006193466B1

(12) United States Patent
Earl

(10) Patent No.: US 6,193,466 B1
(45) Date of Patent: Feb. 27, 2001

(54) COUNTER ROTATING BYPASS PROPELLER

(76) Inventor: Milan Dennis Earl, 345 E. Main St., Moorestown, NJ (US) 08057

( * ) Notice: Subject to any disclaimer, the term of this patent is extended or adjusted under 35 U.S.C. 154(b) by 0 days.

(21) Appl. No.: 09/248,384

(22) Filed: Feb. 11, 1999

(51) Int. Cl.[7] ..... B63H 23/00
(52) U.S. Cl. ..... 416/129; 416/128; 440/93
(58) Field of Search ..... 416/129, 128, 416/130, 17; 415/906, 907, 4.2, 4.4, 3.1; 440/13, 14, 92, 93

(56) References Cited

U.S. PATENT DOCUMENTS

| | | | | |
|---|---|---|---|---|
| 380,967 | * | 4/1888 | Wilcox | 440/93 |
| 975,972 | * | 11/1910 | Martin | 440/93 |
| 1,020,274 | * | 3/1912 | Frazier | 440/92 |
| 1,147,083 | * | 7/1915 | Gibson | 416/129 |
| 2,980,054 | * | 4/1961 | Sanders | 440/92 |
| 4,490,119 | | 12/1984 | Young . | |
| 4,568,290 | | 2/1986 | Brown | 440/13 |
| 5,000,706 | | 3/1991 | Wang | 440/14 |
| 5,021,015 | | 6/1991 | Wang | 440/13 |
| 5,401,196 | | 3/1995 | Triantafyllou et al. | 440/13 |

OTHER PUBLICATIONS

Scientific American Magazine Mar. 1995 Article "An Efficient Swimming Machine" Author: Triantafyllou –pp. 64 to 70.

* cited by examiner

*Primary Examiner*—Edward K. Look
*Assistant Examiner*—Richard Woo

(57) ABSTRACT

A propulsion device having fins rotating in opposing directions which are adjustable to avoid collision yet which provide opposing strokes similar to fishtails. At least one adjustable fin is connected at an end of a rotatable hollow primary axle which coaxially encompasses a secondary rotatable axle extending a distance from the end of the primary axle and having at least one adjustable fin at that end. Primary fins are adjusted distally during their trust segment of rotation and secondary fins are adjusted proximally during their thrust segment of rotation to enter a common thrust sweep zone. Fins are adjusted in a timed relationship to provide thrust while occupying the thrust sweep zone and thereafter adjusted out of the thrust sweep zone to avoid collision with opposing fins. Fins are additionally adjusted to assume a low resistance configuration during non thrust segments of rotation in order to reduce drag.

7 Claims, 12 Drawing Sheets

COUNTER ROTATING BYPASS PROPELLER

BACKGROUND

1. Field of Invention

This invention relates to propellers which provide thrust through fluids.

2. Description of Prior Art

The propeller is a common device used to provide the force necessary to move objects trough air and water. Although many variations and improvements have been suggested throughout the years, the basic concept of propellers has remained unchanged. Rotary motion provided by an energy source such as internal combustion, electricity, or manpower causes angled blades to turn, thereby forcing the fluid substantially in a direction, and causing the craft to which the propeller is attached to move in an opposite direction.

Although common propellers at the present time are considered the best method of providing motion for boats through water, they fall far short of having the efficiency which is achieved by aquatic life in the natural world. Propellers may be powerful devices, but much of the energy is wasted on formation of disturbances in the water.

The tail fins of fish and other aquatic creatures provide more thrust with less effort. Designing machines which Approximate fishtail efficiency has proven to be a formidible task. As noted in prior art U.S. Pat. No. 5,401,196, the sweep of a fish tail creates a vortex in water which rotates in a manner which has proven to be invaluable for fish propulsion efficiency. The following stroke reacts with the water movement created by that vortex to create a greater thrust in the forward direction than if the vortex were not present. This cancelling effect between the created vortex and the oncoming fin is believed to be a a factor in high fishtail efficency. At the same time, the following stroke continues the process by creating its own new vortex to be used in a similar manner by a subsequent stroke in the opposite direction. The successive vortices and strokes provide an efficient propulsion method which has yet to be effectively duplicated by a mechanical device.

Even though many efforts have been made to mimic the design of the tail fin of a fish, these designs have been unsuccessful in replacing the common propeller in providing acceptable thrust for watercraft. Because of design improvements of rotary motors producing increased power, propellors have remained the choice for propulsion. The present device utilizes the tailfin action of fishes while incorporating rotary motion provided by any conventional energy source such as electric motors and internal combustion engines. These sources are powerful and reliable, and have been perfected over the years. Since, as will be demonstrated, the motion of the fin is not reversed in the instant device, energy is not wasted in stopping, then accelerating the fin in an opposing direction. Stress on the fin caused by this reversing motion is therefore eliminated. Additionally, since the opposing fins of the instant device present a novel configuration which allows for the immediate reaction of fin and water in a reversed direction, the device closely resembles the action of fishtails. The proposed mechanism simply but effectively combines the advantages of both the common propeller and natural fish-tail motion.

Prior art reveals several disadvantages overcome by the present design. In causing a fin to flap back and forth, devices of the prior art must first stop motion in one direction, then accelerate the fin in the opposite direction.

Since most mechanical systems are rotational, converting to a flapping motion tends to be complex and inefficient, requiring linkage and other conversion design. This complexity is not present in the instant device. Also, by continual rotation of different blades in opposite directions, no energy is lost in stopping and starting. Since the momentum of the blades is substantially conserved, the energy of motion may be used in subsequent strokes. Frictional losses caused by the interaction between the blades and the water during the non-thrust segment of their rotation are reduced by minimizing the surface area of the blade reacting with the water. A pivoting, folding, rolling, or compressing manuever accomplishes this task and also allows for the bypass of the opposing blades to avoid collision while permitting the opposing blades to alternately occupy overlapping sweep zones.

The present device has many advantages over all prior art. The cited prior art U.S. Pat. Nos. 4,490,119, 4,568,290, 5,000,706, 5,021,015 and 5,401,196 all represent propulsion systems having one or more reciprocating foils, therefore having the associated problems. The instant mechanism represents a novel approach which, rather than vibrate foils, rotates separate foils in opposing directions while allowing collision-free bypass and reducing drag during non-thrust segments of the rotation. A major advantage of this design is that the effective thrust frequencies which may be generated by counter-rotating fins surpass those anticipated for flapping foils effectively, thereby creating a new range of values for fishtail simulation. Most materials, when flapped from side to side under stress, experience fatigue and eventually break down in some manner or another. The blades of the proposed device are not subjected to this abuse since the blades are not flapped. Fishtail motion is still approximated, in that a vortex created by a sweep reacts with a successive sweep in the opposite rotational direction. In order to increase efficiency, parameters such as frequency, fin size, fin shape, fin flexibility, and sweep length are easily adjusted in the instant device. "*An Efficient Swimming Machine*", a Scientific American magazine article of March 1995 presents a prior art analysis of such parameters. That article also describes a robotic tuna constructed for experimental purposes, and illustrates the complexity of such a device over the proposed mechanism.

OBJECTS AND ADVANTAGES

Several objects and advantages of the present invention are:

(a) to provide a propeller which can be used for propulsion in fluids, especially water;

(b) to provide a method of propulsion incorporating the advantages of the action of a fish tail and rotational motion;

(c) to provide a propeller which has two or more fins which rotate in opposite directions and are deployable in a timed manner to occupy a substantially common thrust sweep zone yet avoid collision;

(d) to provide a propeller which may be easily adapted to operate in association with internal combustion engines, electric motors, human power and other forms of power;

(e) to provide a propeller which will allow for blades of different shape, flexibility, strength, consistency, and size;

(f) to provide a propeller which may be steered in any direction;

(g) to provide a propulsion system having two or more fins rotating in opposing directions and which are retractable by alternating in a timed relationship during rotation between vertical orientation in order to maximize resistance during thrust segments of rotation and horizontal orientation in order to minimize resistance during non-thrust segments of rotation and to avoid collision;

(h) to provide a propeller which allows for optional methods of retraction, such as pivoting, folding, rolling, and compressing for bypass of counter-rotating fins.

(i) to provide a fishtail-simulating propellor which may be operated effectively at higher frequencies than vibrating foils.

Figure 1:
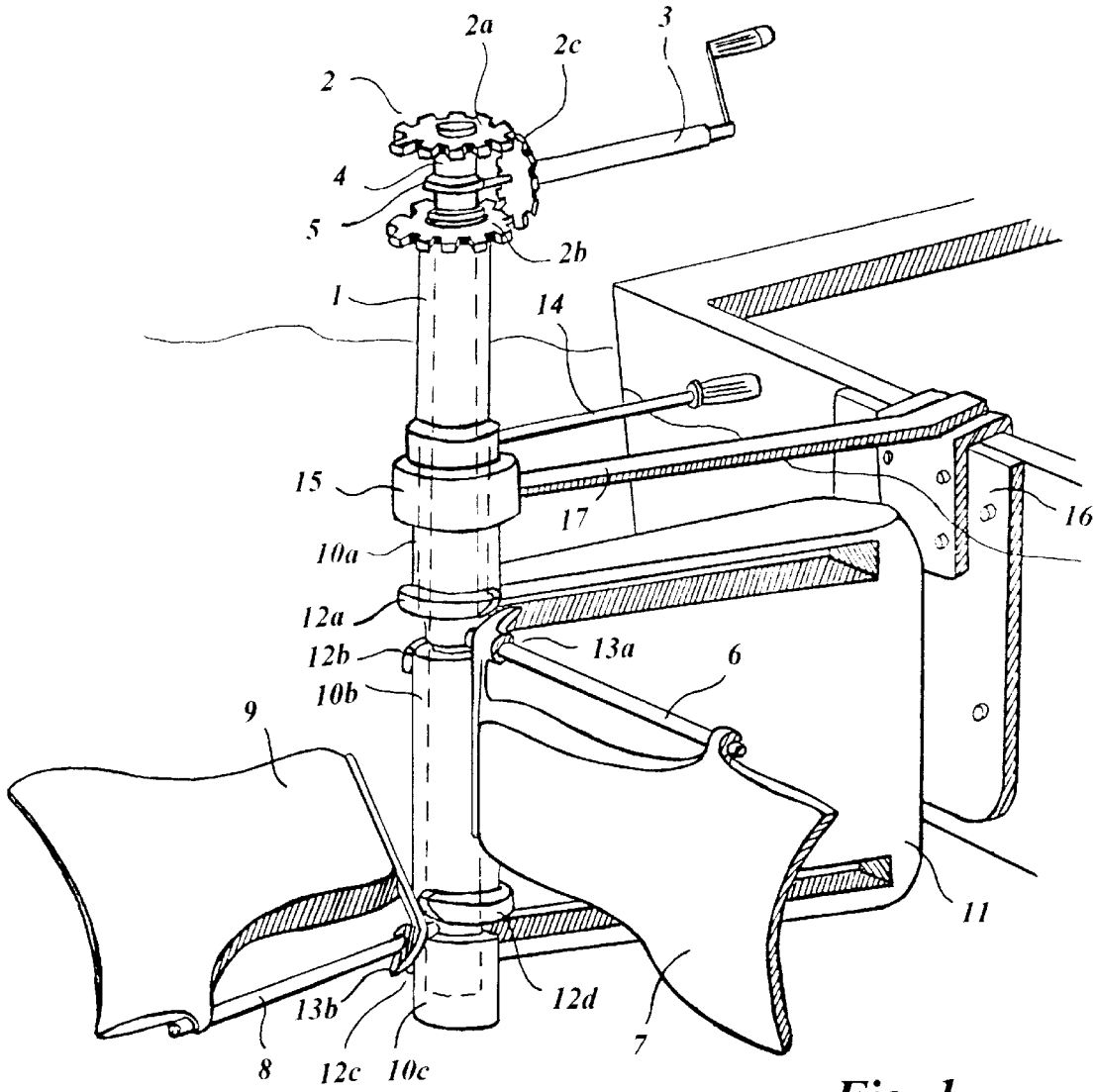
FIG. 1 illustrates an aspect of the present invention having two fins and attached to the transom of a boat.

| Reference Numerals in Drawings | |
|---|---|
| 1 primary axle | 2 gear assembly |
| 2a top gear | 2b bottom gear |
| 2c drive gear | 3 crank |
| 4 secondary axle | 5 crank support ring |
| 6 upper arm | 7 upper fin |
| 8 lower arm | 9 lower fin |

-continued

| Reference Numerals in Drawings | |
|---|---|
| 10a upper support cylinder | 10b middle support cylinder |
| 10c lower support cylinder | 11 bracket |
| 12a upper fin vertical deflector | 12b upper fin horizontal deflector |
| 12c lower fin vertical deflector | 12d lower fin horizontal deflector |
| 13a upper fin pivoter | 13b lower fin pivoter |
| 14 steering arm | 15 major support cylinder |
| 16 boat transom | 17 connecting arm |
| 18a–18l representative positions of upper fin | |
| 19a–19l representative positions of lower fin | |
| 20a upper vertical buffer | 20b upper horizontal buffer |
| 20c lower horizontal buffer | 20d lower vertical buffer |
| 21 supplemental upper fin | 22 supplemental lower fin |
| 23 supplemental drive gear | 24 supplemental axle gear |
| 25 supplemental primary axle | 26 motor |
| 27 power chain | 28 sprocket arrangement |
| 28a upper drive sprocket | 28b middle drive sprocket |
| 28c lower drive sprocket | 29 power shaft |
| 30 upper chain | 31 upper sprocket |
| 32 lower chain | 33 lower sprocket |
| 34 solenoid | 34a rod |
| 34b winding | 34c spring |
| 35 primary axle brushes | 36a battery brushes |
| 36b battery wires | 37 battery |
| 38 solenoid wires | 39 connecting pin |
| 40 fin rotator | 41 lower position |
| 42 pivotable fin axle | 43 secondary axle brushes |
| 44 folding fin | |

SUMMARY

In accordance with the present invention a hollow rotatable axle having an adjustable fin assemblage radially connected at an end coaxially encompasses a secondary rotatable axle having a secondary adjustable fin assemblage radially connected at an end whereby primary and secondary rotatable axles are made to rotate in a timed relationship in opposing directions and primary and secondary fin assemblages are made to deploy in a timed relationship into a substantially common thrust sweep zone during thrust segments of rotation and thereafter are adjusted to bypass.

DESCRIPTION OF THE PREFERRED EMBODIMENT(S)

A typical embodiment of the propeller of the present invention is illustrated in FIG. 1. The propeller consists of primary axle 1 driven at gear assembly 2. Gear assembly 2 is comprised of the combination of gear 2*a*, gear 2*b*, and gear 2*c*, which are powered at crank 3 in a clockwise manner. Crank 3 represents a manual power mode of the present device for clarity sake, however power may be supplied by virtually any conventional method. Secondary axle 4 is of smaller diameter than primary axle 1 and located coaxially within primary axle 1. Secondary axle 4 extends beyond primary axle 1 both at distal and proximal ends. At the proximal end, gear 2*a* is affixed to secondary axle 4, being the topmost gear of gear assembly 2. Gear 2*b* is affixed to the proximal end of primary axle 1, being the bottommost gear of gear assembly 2. Gear 2*c* is affixed to crank 3 and intercommunicated with gears 2*a* and 2*b* in the manner illustrated. Secondary axle 4 rotates within crank support ring 5. Gears are configured such that clockwise motion of crank 3 induces a clockwise motion of primary axle 1 as viewed from above, and clockwise motion of crank 3 induces a counter-clockwise motion of secondary axle 4. Rotational motions of outer primary axle 1 and secondary axle 4 are therefore in opposition and, because the size of the gears are identical, are maintained at the same turning rate by gear assembly 2.

Upper arm 6 extends radially from the distal end of primary axle 1. Upper fin 7 pivots around upper arm 6. Lower arm 8 extends radially from the distal end of secondary axle 4. Lower fin 9 pivots around lower arm 8. Upper arm 6 and lower arm 8 are spaced apart a distance sufficient that if either of the fins are horizontally oriented, the opposing fin may safely bypass without collision when vertically oriented. Upper support cylinder 10*a*, middle support cylinder 10*b*, and lower support cylinder 10*c* allow free rotation of primary axle 1 and secondary axle 4 and are affixed to bracket 11. Bracket 11 is of swept design in order to facilitate water flow in the direction of motion thereby minimizing resistance, and has apertures allowing unobstructed passage of the horizontal rotating fins. Secondary axle 4 extends a distance beyond lower arm 8 into support cylinder 10*c* for added stability. Upper fin vertical deflector 12*a* is affixed to support cylinder 10*a* and is positioned to induce upper fin 7 to pivot to a vertical orientation during the thrust segment of its rotational cycle upon interaction with upper fin rotater 13*a*. The thrust segment of the rotation is herein defined as that rotation which occurs when the surface area of the fin with respect to the direction of rotation is maximized, thereby maximizing thrust. Upper fin horizontal deflector 12*b* is fixedly attached to support cylinder 10*b* and is positioned to induce upper fin 7 to pivot to horizontal orientation during the non-thrust segment of its rotational cycle upon interaction with upper fin rotater 13*a*. Horizontal orientation of the fins presents a small surface area in the direction of rotation, therefore minimizing resistance to fluid flow. This low resistance mode allows for less drag while the fins are rotated in a direction other than the desired thrust direction. In a similar arrangement, lower fin vertical deflector 12*c* is affixed to support cylinder 10*c* and induces lower fin 9 to pivot to vertical orientation during the thrust segment of its rotational cycle upon interaction with lower fin rotater 13*b*. Lower fin horizontal deflector 12*d* is affixed to middle support cylinder 10*b* and pivots lower fin 9 to the horizontal position during the non-thrust segment of its rotational cycle upon interaction with lower fin rotater 13*b*. Because of the spacing between fin arms and the pivoting motions indicated, both fins enter an common thrust sweep zone located between the planes of rotation of upper arm 6 and lower arm 8 and are prevented from colliding by timed pivoting of the fins. Positions of crossover, wherein one of the fins is pivoted to horizontal orientation allowing bypass of the opposing fin, are determined by length and placement of deflectors. By placing deflectors appropriately, fins are timed to deploy into the trust sweep zone, provide maximum thrust during a thrust segment of rotation in which the maximum surface area of the fin reacts perpendicularly to the direction of rotation, and thereafter retract from the thrust sweep zone to a non-thrust orientation. Fishtail action may be simulated whereby both fins alternately are deployed into the thrust sweep zone and into vertical orientation and the thrust segments of rotation overlap but are occupied at different times. By pivoting the fins sustantially simultaneously, the vortex produced by a fin is utilized by the succeeding fin to increase thrust.

Steering arm 14 is affixed to upper support cylinder 10*a* and rotates attached components so that thrust segments of rotation of upper fin 7 and lower fin 9 may be oriented in a desired direction, thereby providing thrust in a desired direction. Steering arm 14 represents a simplified manner of steering and can obviously be replaced by many forms of steerage currently in use. Main support cylinder 15 encompasses upper support cylinder 10*a* and is firmly affixed to boat transom 16 through connecting arm 17. Although connecting arm 17 is herein represented as immobile with respect to other components, an embodiment allowing for shifting of this arm in timed relation to blade thrusts may provide a lateral movement also observed in fishes. Such heave action may further increase the efficiency of the system by altering the incident angle of reaction between successive fin strokes and previously created vortices.

When upper fin 7 fully pivots to vertical orientation and is deployed into the thrust sweep zone, lower fin 9 is fully horizontal and out of the thrust zone, thereby allowing upper fin 7 to bypass safely yet react with a vortex created by lower fin 9. Lower fin 9 continues its rotation in horizontal orientation, minimizing resistance, until it is pivoted to vertical orientation substantially 180° later. Upper fin 7 remains vertically oriented producing thrust within the thrust sweep zone until it is pivoted to horizontal substantially 180° later. At that location, lower fin 9 bypasses horizontal upper fin 7 and initiates its thrust segment within the thrust sweep zone. Subsequent rotations produce alternating thrusts, each reacting with previously-produced vortices.

Figure 2:
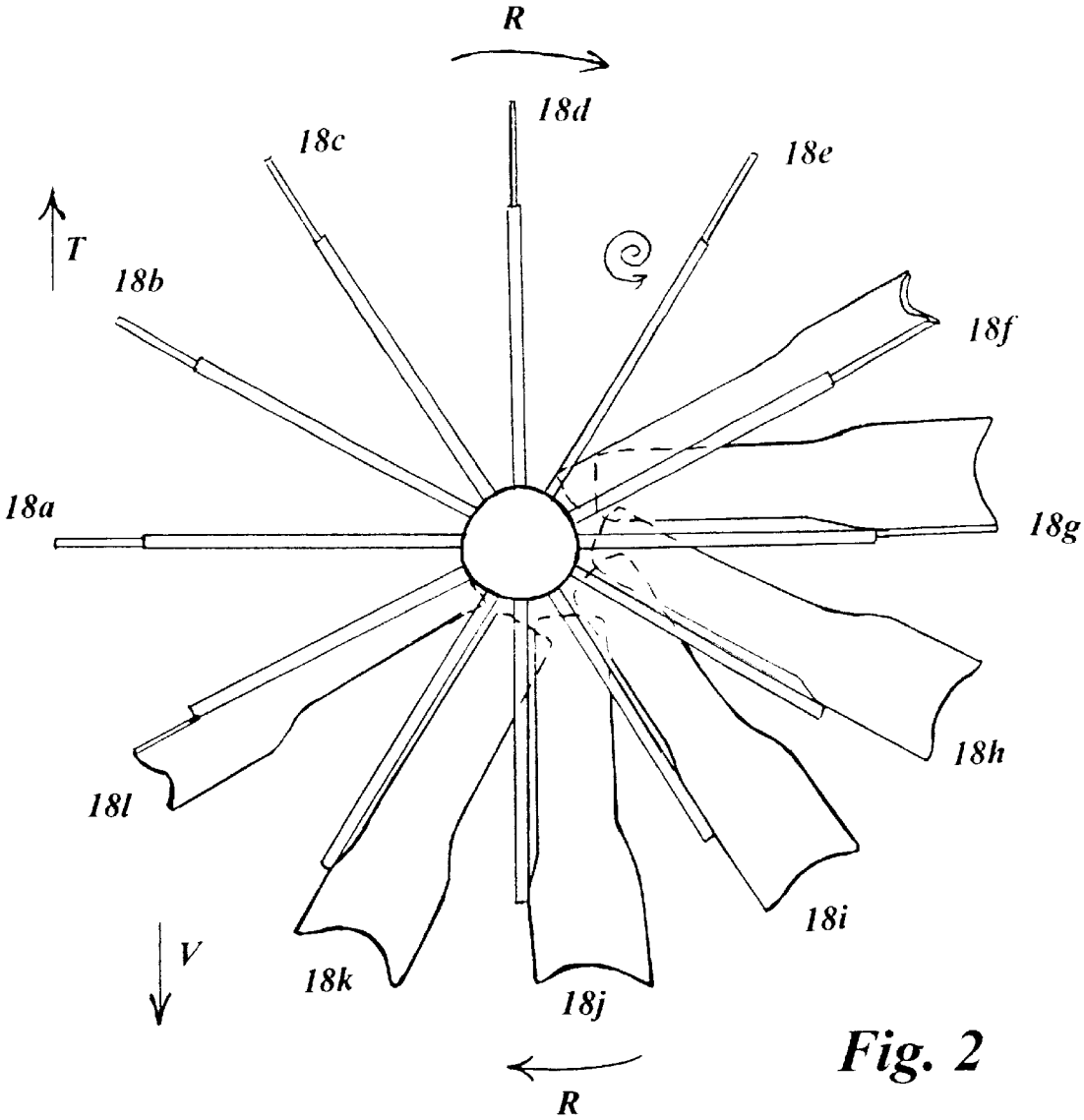
FIG. 2 illustrates an overhead view of the vertical and horizontal positions of the upper fin at several representative stages during a complete cycle.

FIG. 2 illustrates a downward view of representative positions of upper fin 7 during one clockwise rotation. Arrow R indicates clockwise directional motion, arrow T represents substantially the direction of thrust, and arrow V represents the direction of movement of the boat. At position 18*a* upper fin 7 is in fully vertical orientation and remains so until position 18*e*, thereby providing maximum thrust, occupying the thrust sweep zone, reacting with a previous vortex, and creating a new vortex. The illustrated whirlpool represents a vortex created by this thrust segment of upper fin 7 and resembles a vortex created by a fish tail. Position 18*f* represents partial pivoting toward horizontal of upper fin 7 around upper arm 6. Position 18*g* illustrates upper fin 7 fully horizontal and out of the thrust sweep zone, thereby allowing lower fin 9, now in a fully vertical orientation and not illustrated in FIG. 2, to pass under. Lower fin 9 thereby sweeps through a substantial part of the sweep thrust zone that upper fin 7 occupied immediately before. In a fishlike manner, lower fin 9 reacts with the vortex created by upper fin 7. Upper fin 7 continues horizontally during a non-thrust rotational segment from positions 18*g* through 18*k*. In this horizontal segment, resistance to water flow is reduced since the cross-sectional area opposing the water is now the thin edge of upper fin 7. Position 18*l* illustrates upper fin 7 in partial rotation toward vertical orientation and 18*a* represents full vertical orientation, once again beginning a thrust segment within the thrust sweep zone.

Figure 3:
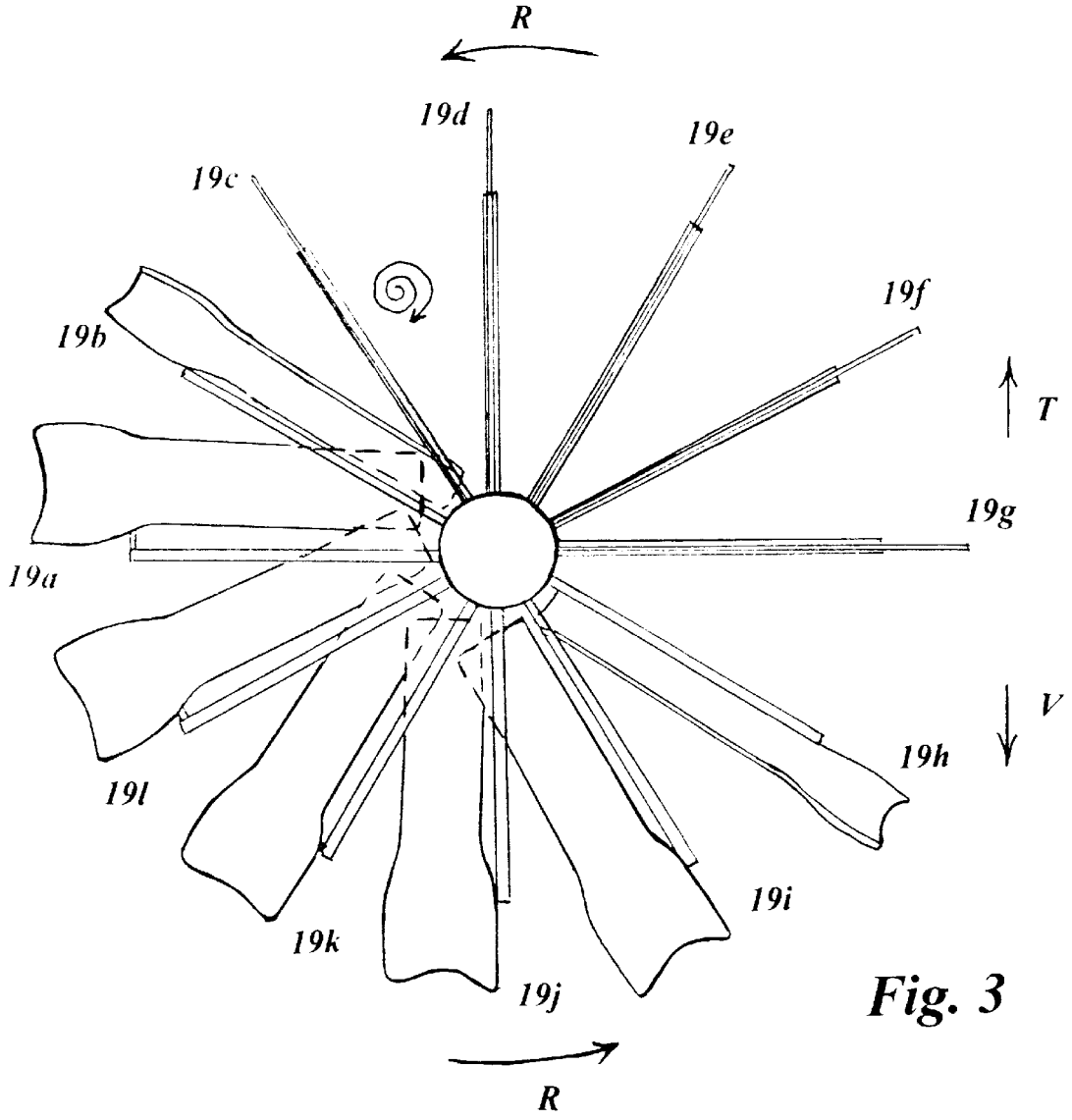
FIG. 3 illustrates an overhead view of the vertical and horizontal positions of the lower fin at several representative stages during a complete cycle.

In order to further illustrate the bypass motion of the fins, FIG. 3 illustrates a downward view of lower fin 9 during one counter-clockwise rotation. Position 19*a* illustrates lower fin 9 horizontally oriented and beginning the non-thrust segment of rotation. Positions 19*a* and 19*g* are crossover positions wherein opposing fins are horizontal and vertical with respect to each other. These positions correspond to positions 18*a* and 18*g* of FIG. 2. This coordinated motion allows the fins to bypass while still permiting them to occupy the thrust sweep zone in a timed relationship. A comparison of the fin positions in FIGS. 2 and 3 demonstrates the same effect created during the sequential thrust segments that occur in the motion of the tailfin of a common fish, and since the fins of the instant device occupy the same thrust sweep zone, the action is substantially identical to that of fish. The thrust segment of the rotation may be adjusted by repositioning or by lengthening the horizontal and vertical deflectors. A further possibility of improved performance may be gained by using flexible or curved fins, wherein the incident angle of the fins with respect to an oncoming vortex create forces more toward the established direction of motion.

Figure 4:
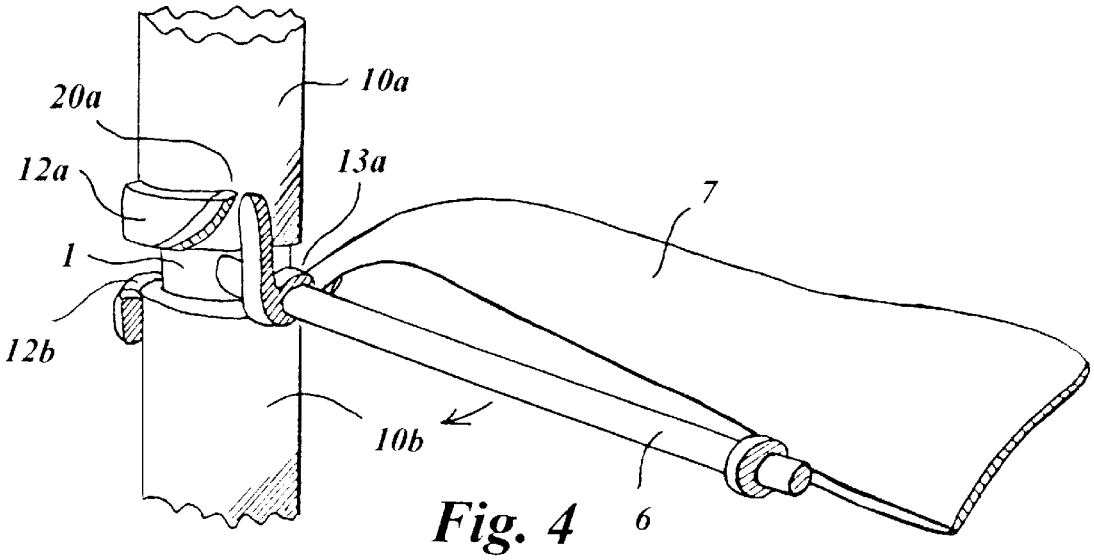
FIG. 4 illustrates a close up of a proposed method for pivoting the upper fin from horizontal to vertical position just before the blade rotates into position to do such.

FIG. 4 illustrates a method by which upper fin 7 is pivoted from horizontal to vertical orientation. Upon further clockwise rotation of primary axle 1, upper fin pivoter 13*a* is forced downward by upper fin vertical deflector 12*a* to which upper vertical buffer 20*a* is attached in order to reduce impact. Since upper fin 7 is affixed to upper fin pivoter 13*a*, it is forced downward into vertical orientation and deployed into the thrust sweep zone. It remains in this orientation until clear of upper fin vertical deflector 12*a*.

Figure 5:
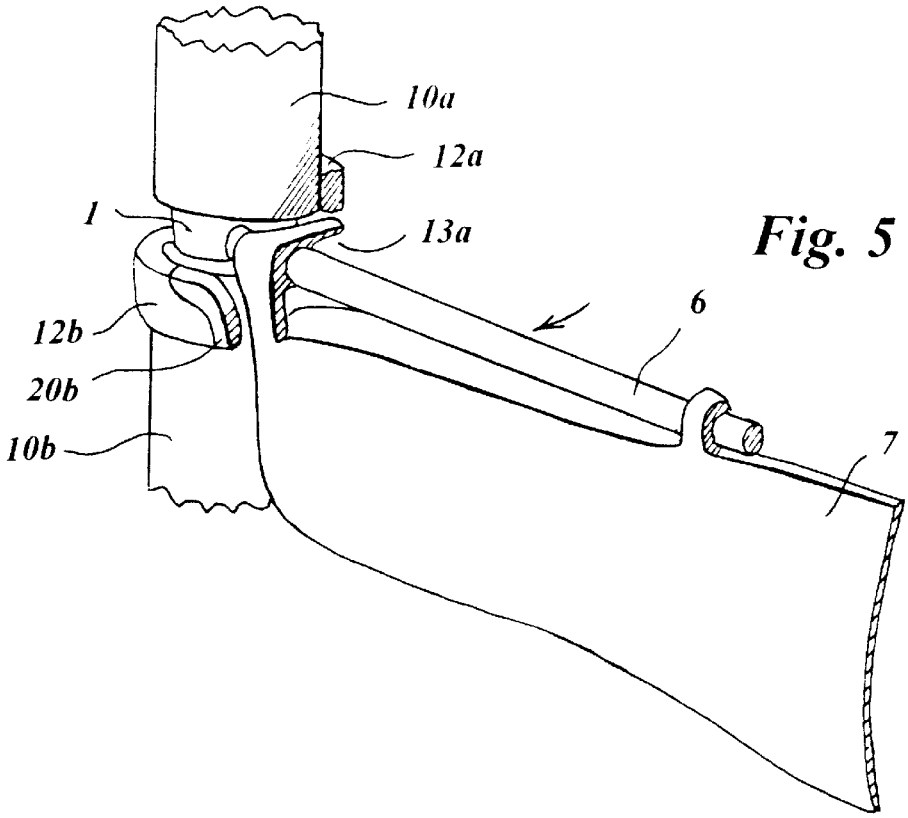
FIG. 5 illustrates a close up of a proposed method for pivoting the upper fin from vertical to horizontal position just before the fin rotates into position to do such.

FIG. 5 illustrates a manner by which upper fin 7 is pivoted from vertical to horizontal orientation. Upon further clockwise rotation of primary axle 1, upper fin pivoter 13*a* is forced upward by upper fin horizontal deflector 12*b* to which upper horizontal buffer 20*b* is attached in order to reduce impact. Since upper fin 7 is affixed to upper fin pivoter 13*a*, it is forced upward into horizontal orientation and retracted from the thrust sweep zone.

Figure 6:
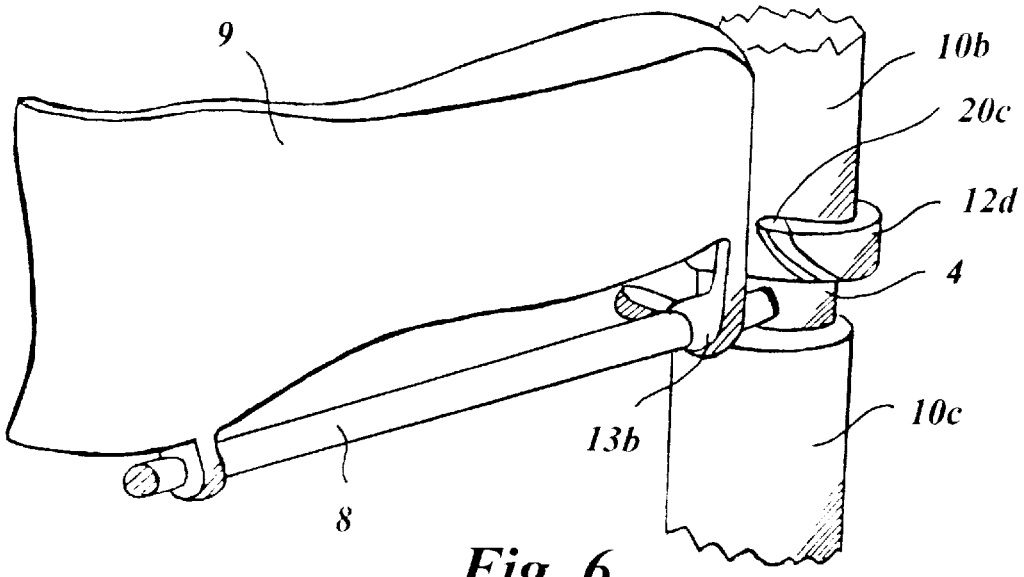
FIG. 6 illustrates a close up of a proposed method for pivoting the lower fin from vertical to horizontal position just before the fin rotates in position to do such.

FIG. 6 illustrates a manner by which lower fin 9 is pivoted from vertical to horizontal orientation. Upon further counter-clockwise rotation of secondary axle 4, lower fin pivoter 13*b* is forced downward by lower fin horizontal deflector 12*d* to which lower horizontal buffer 20*c* is attached in order to reduce impact. Since lower fin 9 is affixed to lower fin pivoter 13*b*, it is forced downward into the horizontal position and retracted from the thrust sweep zone. The reader will note that lower fin 9 is illustrated as flexible and bending from water resistance. This feature may present a better angle of contact for reaction with an oncoming vortex and is observed in fishtails. A further related embodiment may be to hinge the tips of the fins, possibly even to elastically force the hinged areas to sweep in an angle greater than that of the base of the fin itself, thereby creating a greater subsequent vortex.

Figure 7:
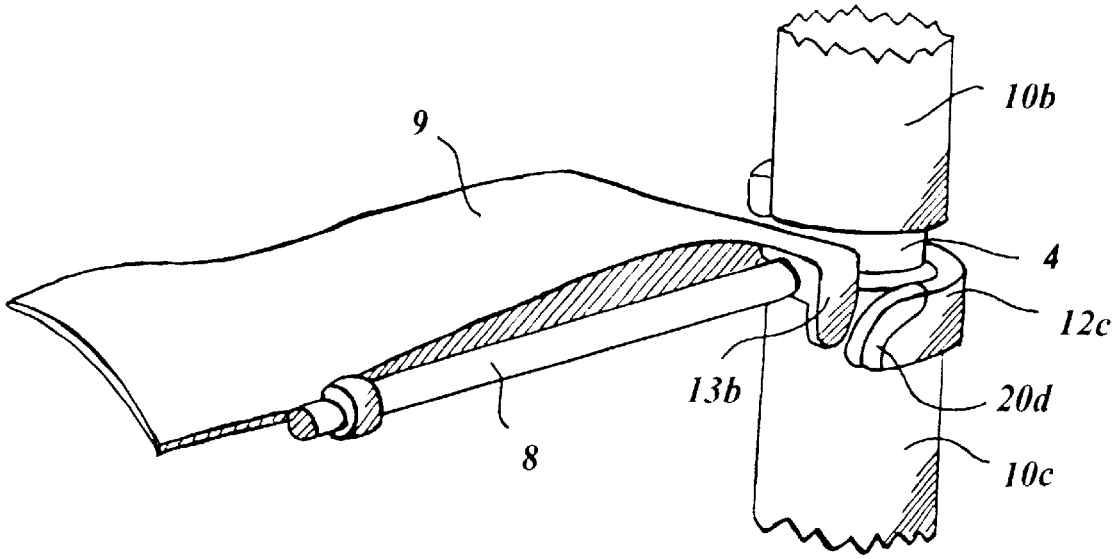
FIG. 7 illustrates a close up of a proposed method for pivoting the lower fin from horizontal to vertical position just before the fin rotates into position to do such.

FIG. 7 illustrates a manner by which lower fin 9 is pivoted from horizontal to vertical orientation. Upon further counter-clockwise rotation of secondary axle 4, lower fin pivoter 13*b* is forced upward by lower fin vertical deflector 12*c* to which lower vertical buffer 20*d* is attached in order to reduce impact. Since lower fin 9 is affixed to lower fin pivoter 13*b*, it is forced upward into vertical orientation and deployed into the thrust sweep zone.

Pivoting actions illustrated in FIGS. 4 through 7 may further be facilitated with the selective use of springs positioned to relieve stress on the pivoting mechanism.

Figure 8:
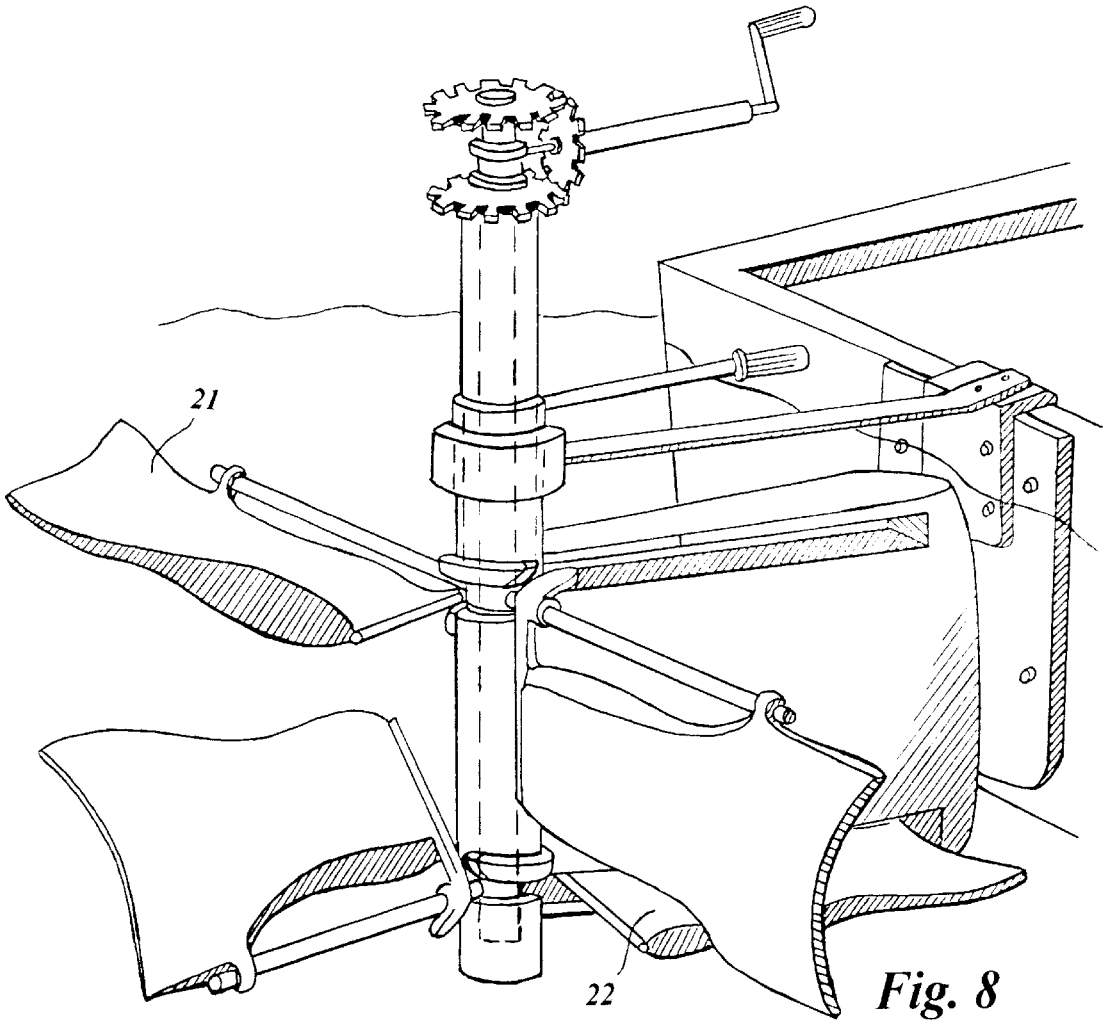
FIG. 8 illustrates an embodiment of the present device having four fins.

FIG. 8 illustrates an embodiment of the present device having four fins. By increasing the number of fins, the possible thrust segment of the rotation decreases in angle, however the number of thrusts per rotation increases. Supplemental upper fin 21 and supplemental lower fin 22 are both illustrated in a horizontal position. Since, in FIG. 8, only one fin occupies the thrust segment at a time, the remaining fins are in horizontal orientation.

Figure 9:
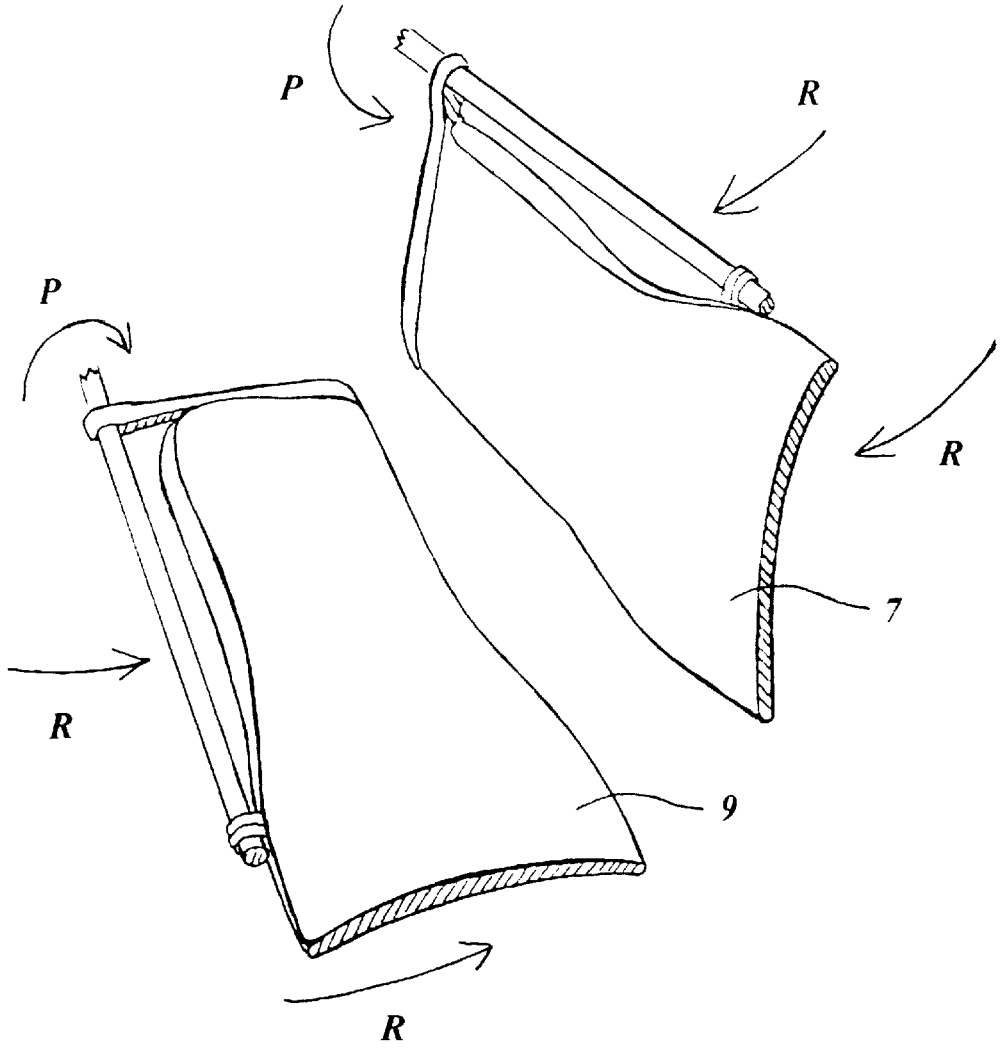
FIG. 9 illustrates a partial aspect of an embodiment of the fins of the device which are made to pivot in the direction of rotation of the axles.

The action of a further embodiment of the instant invention is illustrated in a fragmentary sectional aspect of a crossover position shown in FIG. 9. Upper fin 7 and lower fin 9 are shown immediately after having pivoted. The fins are pivoted in the direction in which the axle, therefore the arm, is rotating. The rotational direction of each arm is represented by their respective R. P illustrates 90° pivot of each fin which has just occurred. Adjustment of the fins may be accomplished in a manner similar to that illustrated in FIGS. 4 through 7. Through this embodiment an advantage may be gained in the creation of additional vortices and a reaction of these vortices with oncoming fins.

Figure 10:
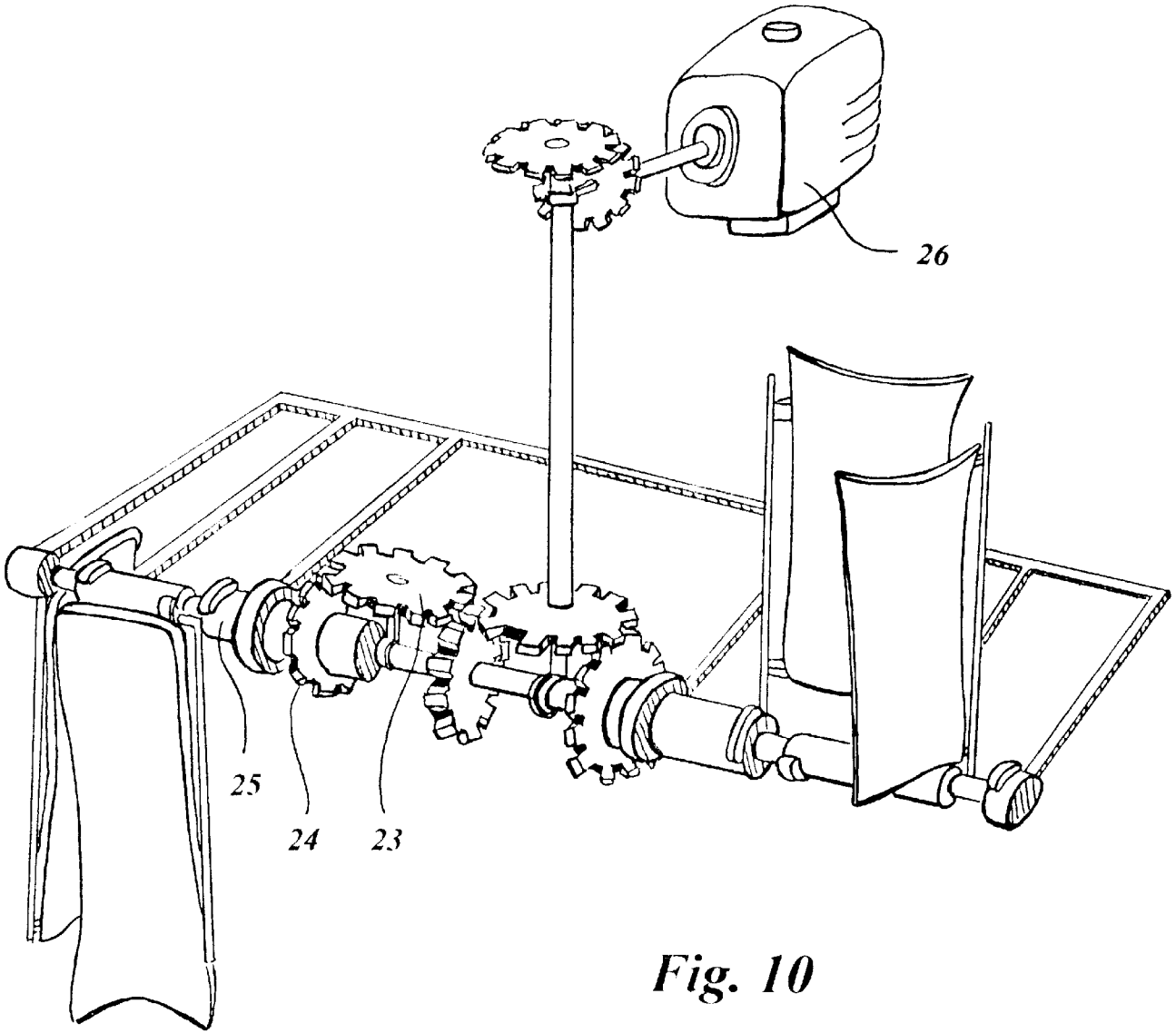
FIG. 10 shows an aspect of a horizontal embodiment of the present device having fin assemblies at both ends of the axles.

A further embodiment of the present device is illustrated in FIG. 10, wherein the axles are horizontally oriented and the arms rotate vertically. Since vortices produced by fin action are created irrespective of gravitational force, the device may be designed to operate at any angle. Addition of supplemental drive gear 23, supplemental axle gear 24, and supplemental primary axle 25 allows attachment of fins at both ends of the device, providing thrust in the same manner as described previously. This embodiment adds balance to the system and spreads the thrust to different locations. Motor 26 is illustrated as supplying rotational energy to the device.

Figure 11:
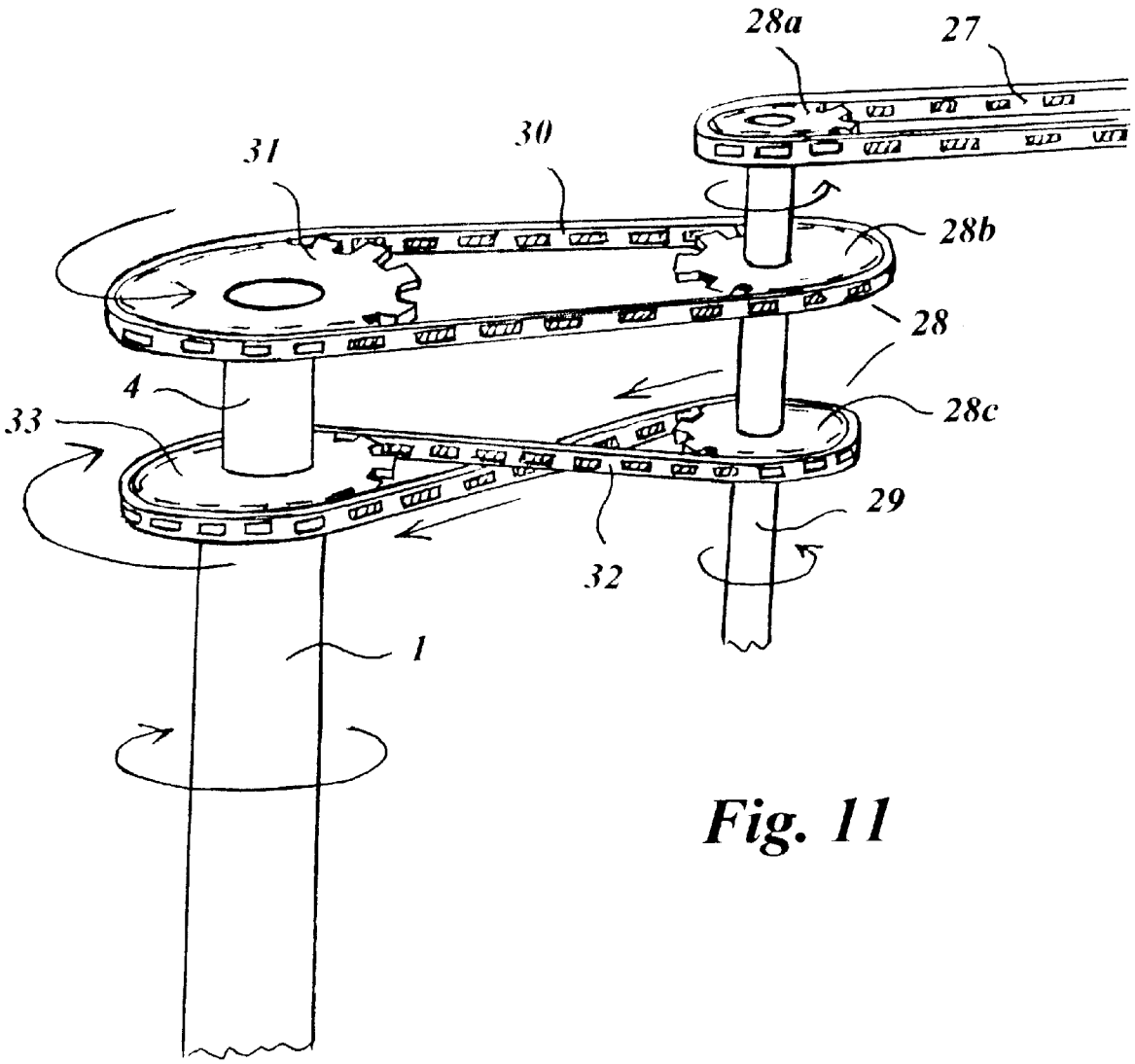
FIG. 11 illustrates a fragmentary embodiment using chains and sprockets to provide counter rotation of the axles.

FIG. 11 illustrates a fragmentary embodiment wherein counter rotation is caused by action of sprockets and chains, rather than gears. Looking downward, power chain 27 is driven in a counter-clockwise manner by an appropriate rotational source and is in communication with upper drive sprocket 28*a*, the uppermost component of sprocket arrangement 28. The rotational directions of the illustration are purposefully reversed to illustrate that the directionality of the device is immaterial. Upper drive sprocket 28*a*, middle drive sprocket 28*b* and lower drive sprocket 28*c* all rotate in a counter-clockwise manner since they are affixed to power shaft 29. Upper chain 30 communicates middle drive sprocket 28*b* and upper sprocket 31, causing a counter-clockwise rotation of upper sprocket 31 and secondary axle 4 to which it is affixed. Lower chain 32 communicates lower drive sprocket 28*c* and lower sprocket 33, and crosses itself one time between sprockets as illustrated. Counter-clockwise rotation of sprocket 28*c* therefore induces a clockwise rotation in lower sprocket 33 and primary axle 1 to which it is affixed. In this manner, secondary axle 4 and primary axle 1 provide counter rotation to fin assemblies.

Figure 12:
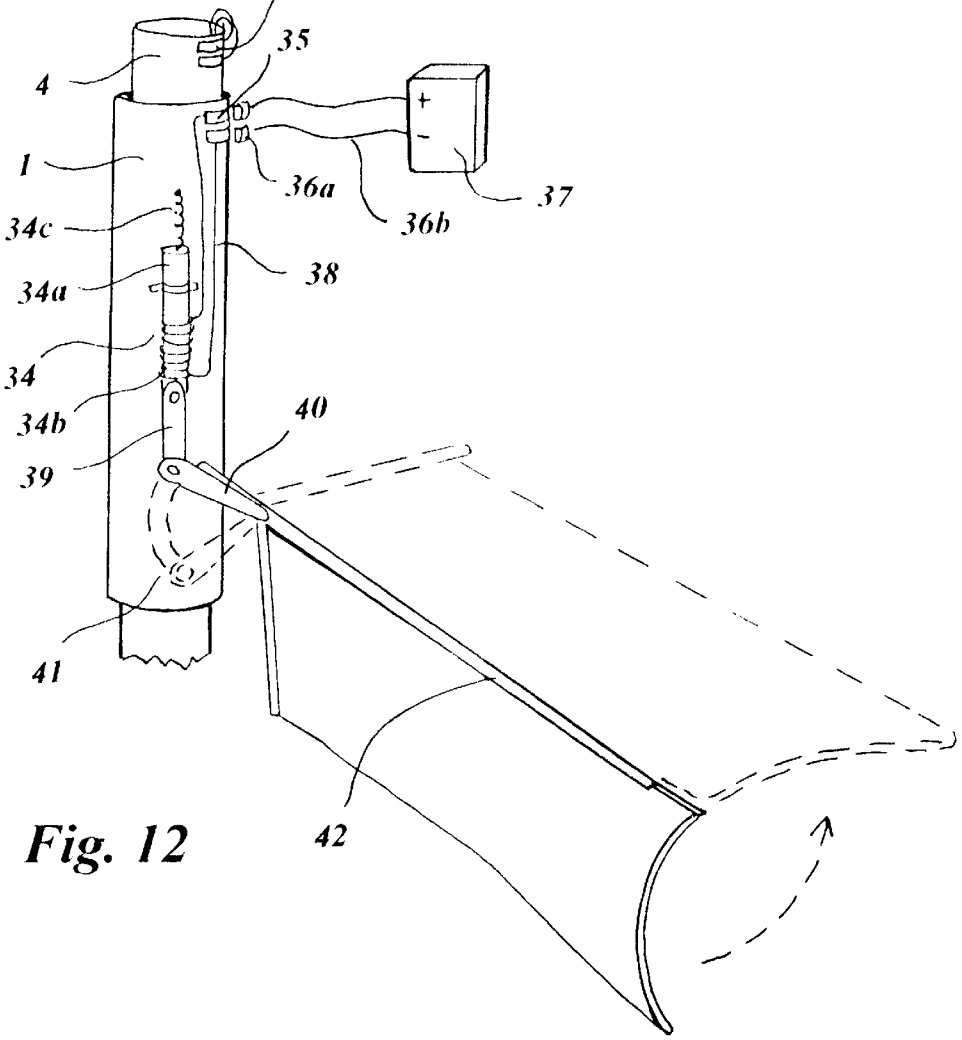
FIG. 12 illustrates a fragmentary embodiment utilizing a solenoid to pivot a fin.

FIG. 12 illustrates a fragmentary embodiment utilizing electromagnetism to pivot a fin during rotation. Solenoid 34 is affixed to primary axle 1 and is comprised of rod 34*a*, winding 34*b*, and spring 34*c*. When primary axle 1 rotates to a position wherein electrical contact is made between primary axle brushes 35 and battery brushes 36*a* which receive current through battery wires 36*b*, electrical energy from battery 37 passes through solenoid wires 38. Electromagnetism is activated in winding 34*b* causing rod 34*a* to be forced downward. Connecting pin 39 is in pivotable connection with rod 34*a* and fin rotator 40, permitting fin rotator 40 to pivot in an arc to lower position 41 when connecting pin 39 is deployed into a fully down position. Because fin rotator 40 is affixed to pivotable fin axle 42, a 90° pivot provides horizontal and vertical adjustment and deployment into and out of the thrust sweep zone. Upon further rotation of primary axle 1 to a position wherein battery brushes 36*b* and primary axle brushes 35 are no longer in contact, winding 34*b* is deactivated and spring 34*c* returns rod 34*a* to its original position. Through the illustrated linkage, connecting pin 39 pivots the fin into a vertical orientation. By utilizing a hollow secondary axle, a similar arrangement may be designed for electromagnetically pivoting the secondary fin assembly. Secondary axle brushes 43 are illustrated to suggest a method for providing electrical energy to a similar solenoid arrangement located at a distal end on secondary axle 4 and not illustrated herein. Electronic switches, such as modules currently in use on automobiles, are a possible alternative for synchronizing adjustment of the fins. Embodiments of the present device utilizing electronics coupled with hydraulic or pneumatic systems for synchronized fin adjustment are also envisioned but not illustrated herein.

Figure 13:
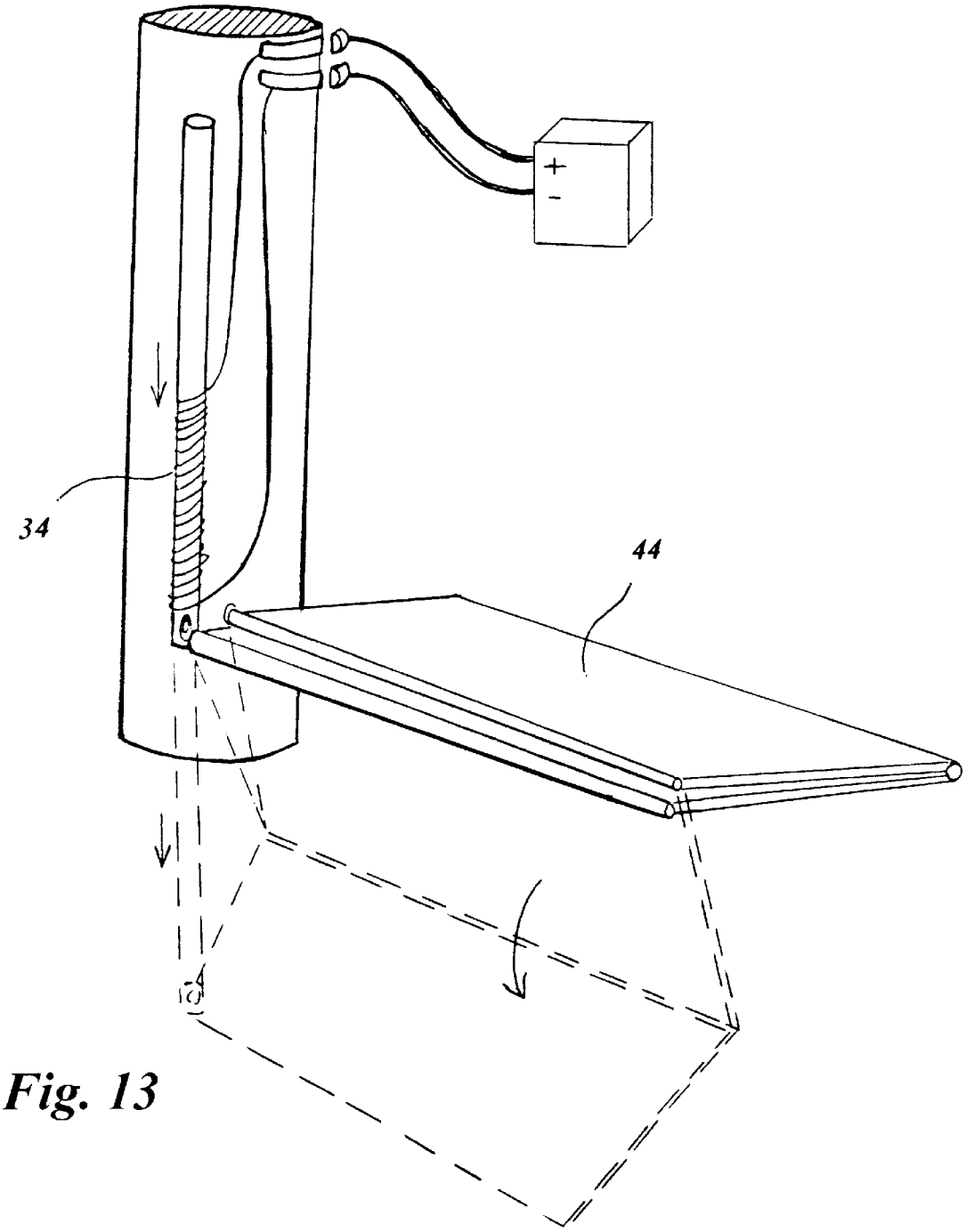
FIG. 13 illustrates a fragmentary embodiment utilizing a solenoid to fold a fin.

A further fragmental embodiment is illustrated in FIG. 13, wherein folding fin 44 opens and closes according to the activation of solenoid 34 in the manner described in FIG. 12. In this embodiment, the fully folded position presents minimum resistance to the fluid. As an extension of this embodiment, the method which adjustably allows for bypass and maximum thrust surface area within the thrust sweep zone may include bending of a pliable fin, window-blind style rolling or accordian-style folding whereby more than one fold is utilized.

Figure 14:
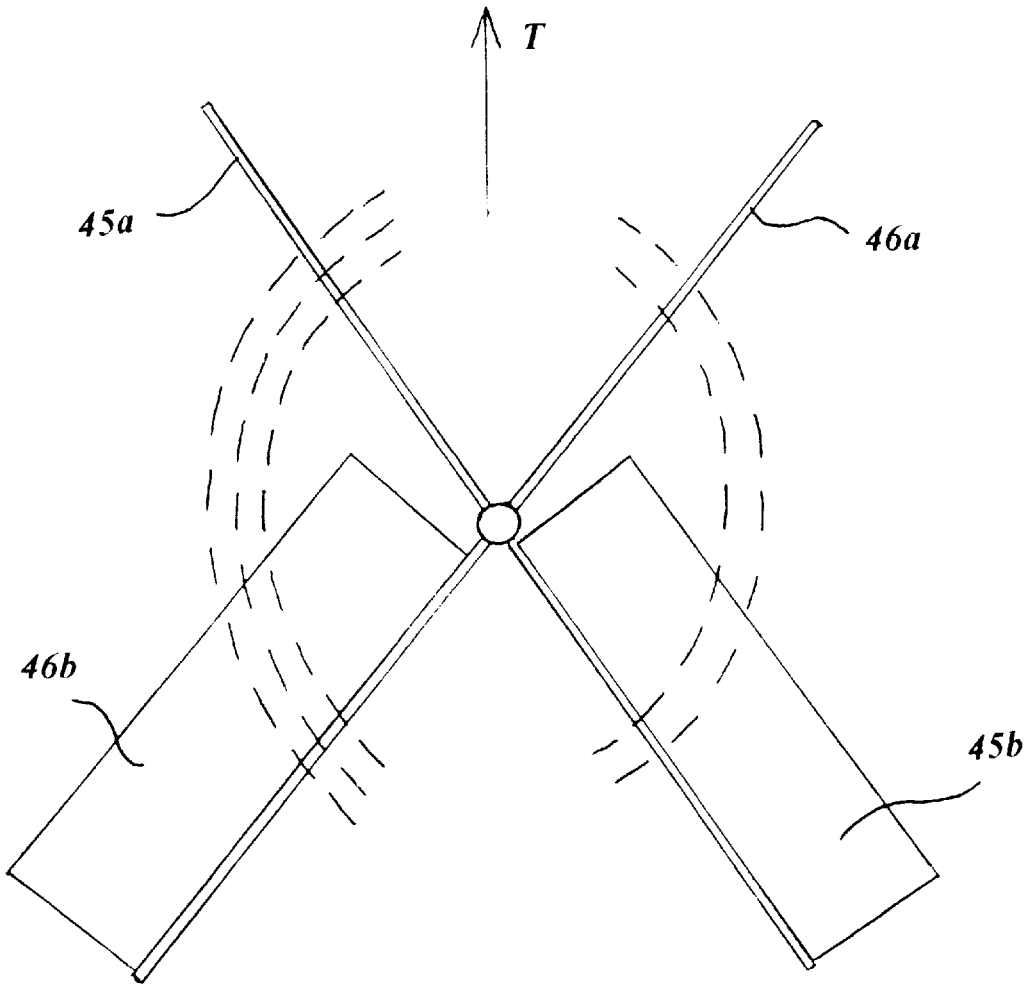
FIG. 14 illustrates an overhead view of an embodiment of the device having four fins, synchronized such that two at a time provide thrust during non-overlapping thrust segments of rotation.

FIG. 14 illustrates an embodiment of the instant device having four fins, two being simultaneously in the thrust mode and bypassing at a crossover location substantially in the direction of thrust, represented by T on the diagram. FIG. 14 shows a downward look at the thrust segments and non-thrust segments of the rotation. Lower S-fin 45*a* and lower T-fin 45*b* share a common shaft, rotate in the clockwise direction and are adjusted to thrust while in a thrust of rotation designated with three dashed arcs. Lower S-fin 45*a* is illustrrated as being within the thrust segment of rotation and approaching a point at which it will be adjusted to horizontal and retracted from the thrust sweep zone. Lower T-fin 45*b* is shown in horizontal orientation and will continue rotation in this low resistance orientation until entering the thrust segment. Simultaneously, in FIG. 14, upper S-fin 46*a* rotates counter-clockwise, is in a thrust segment designated by two dashed arcs, and will continue vertically oriented until exiting its thrust segment of rotation. Upper T-fin 46*b* is illustrated in a low resistance horizontal mode, and will continue in this mode until entering its thrust segment designated by two dashed arcs. By utilizing simultaneous thrusts as illustrated in FIG. 14, several advantages may be gained. A balanced thrust away from the direction of motion is achieved, vortices produced by the simultaneous thrust may still produce the desired fishtail effect, and, during most of the rotation two fins are in the thrust mode. Embodiments having six or eight fins may also produce interesting effects. An embodiment having only two fins, such as shown in FIG. 1 but thrusting simultaneously, allows for closer vertical spacing between arms and may be designed to allow the arms to be nearly centered on the fins and actually occupy the thrust sweep zone. This embodiment is not illustrated herein.

Summary, Ramifications, and Scope

Accordingly, the reader will see that the propeller of this invention presents a novel approach to provide thrust by use of adjustable fins having opposing rotational motion. It allows for synchronized thrust in a common thrust sweep zone, yet adjusts the fins to avoid collision. It allows for fins of different numbers, size, shape, flexibility and composition. It also allows for an increased number of thrust strokes in a given time period, thereby increasing power. Common steering systems, construction methods and power systems may be used in conjunction with the device. The thrust sweeps of opposing fins may be adjusted in duration and direction. Through use of the reaction between fins and vortices created by prior fin strokes, many variations on fishtail propulsion are possible, yielding benefits which may include increased efficiency for watercraft Although the description above contains many specificities, these should not be construed as limiting the scope of the invention but merely providing illustrations of some of the presently preferred embodiments of this invention.

Thus the scope of the invention should be determined by the appended claims and their legal equivalents rather than by the examples given.

What is claimed is:

1. A propelling device comprising:

a) a hollow rotatable primary axle having at least one adjustable primary fin radially connected to at least one end of said primary axle, b) a rotatable secondary axle coaxially enclosed within said primary axle and extending from at least one end of said primary axle and having at least one adjustable secondary fin radially connected substantially to at least one end of said secondary axle, c) means for conveying rotational energy to said primary axle and said secondary axle in opposing directions in a timed relationship, d) deploying means to retractably adjust said at least one primary fin and said at least one secondary fin in a the timed relationship into and out of a common thrust sweep zone, wherein said common thrust sweep zone includes a plane perpendicular to said primary and secondary axles with said at least one primary fin and said at least one secondary fin traversing said plane when they are deployed, e) resistance adjusting means to adjust said at least one primary fin and said at least one secondary fin to a state of high resistance when occupying said thrust sweep zone, f) means to support said primary axle, said secondary axle, said means for conveying rotational energy, said fin deploying means, and said fin resistance adjusting means, whereby said at least one primary fin and said at least one secondary fin are adjusted in the timed relationship during rotation to occupy said thrust sweep zone from opposing rotational directions, to maximize resistance while occupying said thrust sweep zone thereby providing thrust, to avoid collision, to exit said thrust sweep zone, and to thereafter assume a mode of relative low resistance.

2. The device of claim 1 having said at least one primary fin at a distal and a proximal end of said rotatable primary axle and having said at least one secondary fin at a distal and a proximal end of said secondary rotatable axle.

3. The device of claim 1 wherein said at least one primary fin and said at least one secondary fin alternately occupy said thrust sweep zone.

4. The device of claim 1 wherein said at least one primary fin and said at least one secondary fin concurrently occupy said thrust sweep zone.

5. The device of claim 1 wherein said at least one primary fin and said at least one secondary fin are pivotably deployable.

6. The device of claim 1 wherein said at least one primary fin and said at least one secondary fin are foldably deployable.

7. The device of claim 1 wherein said at least one primary fin and said at least one secondary fin are mechanically adjusted by at least one means from a group comprising: deflection, electromagnetism, hydraulics, and pneumatics.

* * * * *